US010258157B2

(12) United States Patent
Wayner et al.

(10) Patent No.: US 10,258,157 B2
(45) Date of Patent: Apr. 16, 2019

(54) FUNCTIONAL RAIL AND WORKSURFACE SUPPORT

(71) Applicant: Haworth, Inc., Holland, MI (US)

(72) Inventors: Robert Clare Wayner, Holland, MI (US); Kristen R. Glick, Holland, MI (US); Mark A. Powell, Grand Haven, MI (US)

(73) Assignee: Haworth, Inc., Holland, MI (US)

( * ) Notice: Subject to any disclaimer, the term of this patent is extended or adjusted under 35 U.S.C. 154(b) by 5 days.

(21) Appl. No.: 15/617,430

(22) Filed: Jun. 8, 2017

(65) Prior Publication Data

US 2017/0354246 A1 Dec. 14, 2017

Related U.S. Application Data

(60) Provisional application No. 62/348,330, filed on Jun. 10, 2016.

(51) Int. Cl.

| | |
|---|---|
| ***A47B 96/14*** | (2006.01) |
| *A47B 13/00* | (2006.01) |
| *E04B 2/74* | (2006.01) |

(52) U.S. Cl.

CPC .... *A47B 96/1441* (2013.01); *A47B 2013/006* (2013.01); *A47B 2200/01* (2013.01); *A47B 2200/12* (2013.01); *E04B 2002/7483* (2013.01)

(58) Field of Classification Search

USPC ..... 108/180, 153.1, 50.01, 50.02

See application file for complete search history.

(56) References Cited

U.S. PATENT DOCUMENTS

| | | | | |
|---|---|---|---|---|
| 4,163,537 | A * | 8/1979 | Mourgue | A47B 17/003 108/156 |
| 4,506,856 | A | 3/1985 | Rich et al. | |
| 4,974,913 | A * | 12/1990 | Vogt | A47B 21/03 108/143 |
| 5,542,654 | A | 8/1996 | Johanson | |
| 5,647,650 | A * | 7/1997 | Daugherty | A47B 57/565 108/180 |
| 5,695,263 | A * | 12/1997 | Simon | H05K 7/183 312/265.1 |
| 5,715,760 | A * | 2/1998 | Frascaroli | A47B 13/023 108/180 |
| 6,076,903 | A * | 6/2000 | Vander Park | A47B 17/003 108/50.02 |
| 6,170,410 | B1 * | 1/2001 | Gioacchini | A47B 87/002 108/153.1 |
| 6,185,887 | B1 * | 2/2001 | Strassle | A47B 57/045 52/282.2 |
| 6,267,064 | B1 * | 7/2001 | Ostertag | A47B 13/021 108/108 |

(Continued)

*Primary Examiner* — Jose V Chen

(74) *Attorney, Agent, or Firm* — Warner Norcross + Judd LLP

(57) ABSTRACT

A functional rail system is mounted to the top of a modular office panel and supports a worksurface on the rail with the worksurface locked in position along the rail. The rail includes a channel in the upper surface for receiving an accessory, and a side accessory slot for mounting the worksurface. The worksurface may be mounted via an upper bracket and a lower bracket interfitted with each other and the side accessory slot to frictionally lock the brackets in place along the longitudinal length of the slot.

20 Claims, 5 Drawing Sheets

(56) References Cited

U.S. PATENT DOCUMENTS

| | | | | |
|---|---|---|---|---|
| 6,283,043 | B1 * | 9/2001 | Stern | A47B 13/06 108/50.02 |
| 6,484,647 | B2 * | 11/2002 | Lininger, Jr. | A47B 83/001 108/50.01 |
| 6,553,730 | B1 * | 4/2003 | Mueller | E04B 2/7433 439/654 |
| 6,725,784 | B2 * | 4/2004 | Crinion | A47B 17/00 108/50.01 |
| 6,749,161 | B1 | 6/2004 | Will et al. | |
| 6,808,334 | B2 * | 10/2004 | Nicoletti | A47B 57/565 403/169 |
| 6,857,712 | B1 * | 2/2005 | Haberman | A47B 21/00 108/102 |
| 6,932,226 | B2 | 8/2005 | Hardy | |
| 6,990,909 | B2 * | 1/2006 | Gosling | A47B 83/001 108/50.02 |
| 7,165,690 | B2 * | 1/2007 | Wu | A47B 96/145 211/187 |
| 7,578,245 | B2 * | 8/2009 | Loines | A47B 87/002 108/108 |
| 8,276,523 | B2 * | 10/2012 | Miller | A47B 21/00 108/50.02 |
| 8,661,765 | B2 * | 3/2014 | Schaefer | A47B 96/14 52/655.1 |
| 8,667,908 | B2 | 3/2014 | Martin et al. | |
| 9,347,213 | B1 * | 5/2016 | Zhang | E04B 1/40 |
| 9,611,641 | B2 * | 4/2017 | Hamilton | A47B 83/001 |
| 9,790,980 | B2 * | 10/2017 | McCarthy | F16B 37/045 |
| 10,036,576 | B1 * | 7/2018 | Robinson | H02S 20/23 |
| 2004/0035332 | A1 * | 2/2004 | Lin | A47B 21/0314 108/50.01 |
| 2009/0273260 | A1 * | 11/2009 | Kemp | A47B 21/06 312/223.3 |

* cited by examiner

FUNCTIONAL RAIL AND WORKSURFACE SUPPORT

BACKGROUND OF THE INVENTION

The present invention is directed to upright wall panel systems of the type typically used in an office environment. These systems generally include a series of upright wall panels joined together in aligned or transverse relationship to divide large open areas into smaller work spaces.

In some cases, work surfaces are supported on the upright panel system. For example, a work surface may be cantilevered to a portion of the upright panel system at an appropriate height, such that the upright panel system supports the weight of the work surface. These solutions, however, present a number of problems. For example, it can be difficult to utilize structure in the panel system that can support the weight of a work surface (and the accessories typically placed on the work surface). It can be particularly difficult to attach work surfaces at the top rail of a panel system, because these systems generally utilize the top rail for mounting an aesthetically pleasing top cap or an accessory such as a privacy screen or shelving unit.

SUMMARY OF THE INVENTION

The present invention provides a functional rail system that can be mounted, for example, to the top surface of a modular office panel and that supports an accessory such as a worksurface on the rail with the worksurface locked in position along the rail.

In one embodiment, the functional rail system includes an elongated rail having a longitudinal length, an upper surface, a lower surface, a first side surface and a second side surface opposite the first side surface. A channel is defined in the upper surface for receiving an accessory, the channel has a pair of opposing sidewalls joined by a channel floor. A side accessory slot is defined in at least one of the first side surface and the second side surface, the side accessory slot includes an upper sidewall, a lower sidewall, and a floor, and at least one wall extending into the slot from one of the upper sidewall and the lower sidewall.

In another embodiment, an upper bracket and a lower bracket are interfitted with each other and the accessory slot, and each of the upper and lower brackets includes a rail section and a support section, wherein a portion of the rail section of one of the brackets is positioned in front of a portion of rail section of the other bracket, and wherein a worksurface is attached to the support section of one of said upper and lower brackets. The upper bracket rail section includes a base, a first leg extending upwardly from the base and a second leg extending downwardly from the base, wherein the first leg is positioned in the accessory slot behind the at least one wall extending into the slot from one of the upper sidewall and the lower sidewall, and wherein the second leg is positioned in front of a portion of the lower bracket. The lower bracket rail section may include a base and a second leg extending upwardly from the base, the second leg positioned between the second leg of said upper bracket and the accessory slot floor.

In one embodiment, the support sections of the upper and lower brackets are spaced from the elongated rail, and the support sections are connected to each other such that the second leg of the upper bracket is pressed against the second leg of the lower bracket. More particularly, the inner surface of the first leg of the upper bracket is horizontally pressed against the wall extending from the upper sidewall of the slot, and the second leg of the upper bracket horizontally presses the second leg of said lower bracket against the floor of the slot to frictionally lock the brackets in place along the longitudinal length of the slot.

The present invention also provides a method for mounting a worksurface on a functional rail, including the steps of: (a) providing a functional rail having a longitudinal length, an upper surface, a lower surface a first side surface and a second side surface opposite the first side surface, (b) inserting upper and lower brackets into the accessory slot such that said upper and lower brackets interfit with each other and said slot, the brackets each including a rail portion and a support portion spaced from the rail portion; (c) drawing the support portions of the respective brackets toward one another to lock the rail portions of the brackets within the accessory slot and to lock the brackets in place along the length of the accessory slot, and (d) attaching an accessory to the support portion of at least one of the brackets such that the accessory is supported by the functional rail and the brackets.

DETAILED DESCRIPTION OF THE CURRENT EMBODIMENTS

I. Overview

Figure 1:
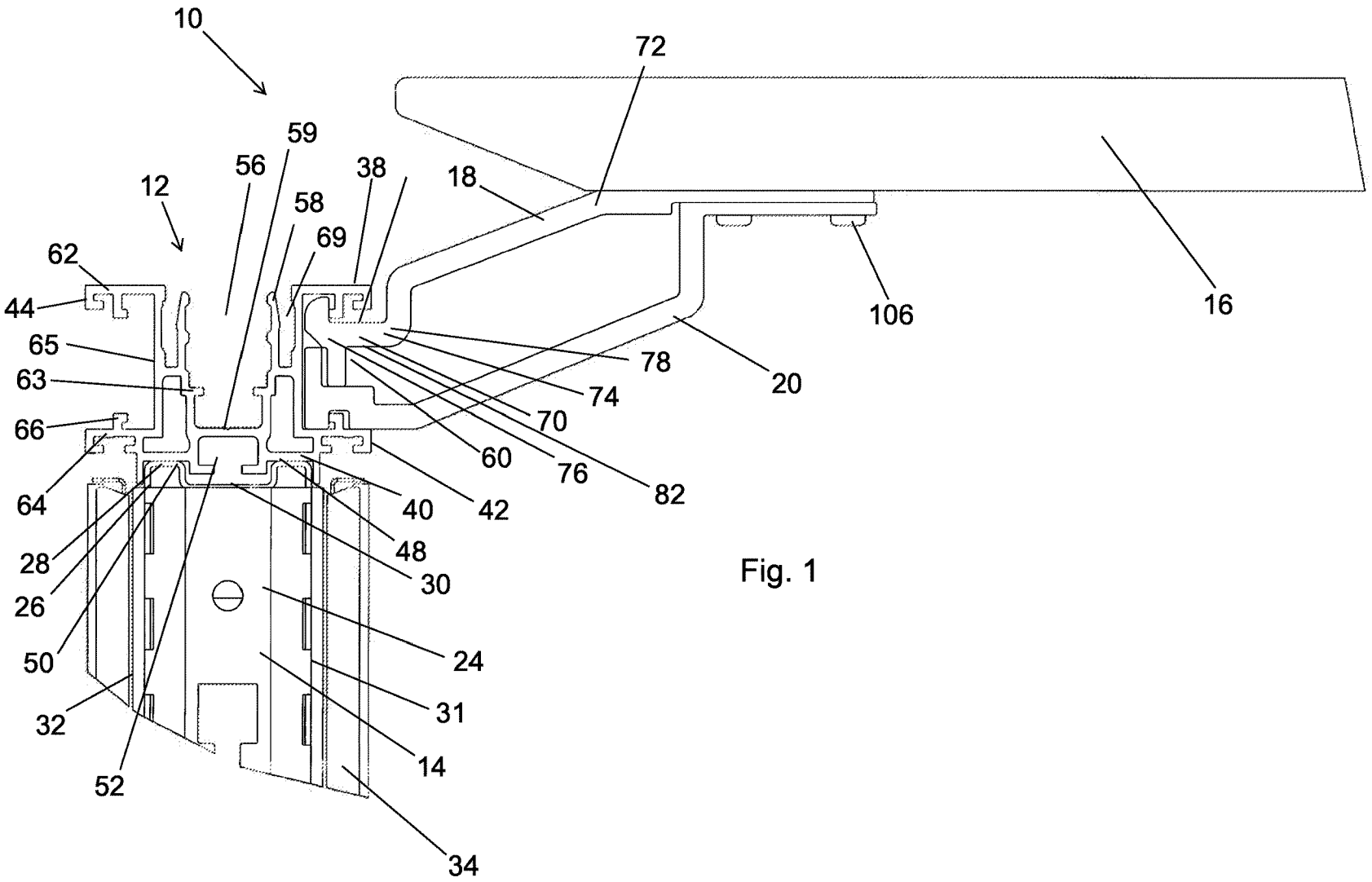
FIG. 1 is a side view according to one embodiment of the present invention including a functional rail mounted on a panel structure and a worksurface mounted on the functional rail.

A functional rail system according to one embodiment of the present invention is shown in FIGS. 1-5 and generally designated 10. The system 10 includes a functional rail 12, which may be mounted on a panel structure 14, such as a modular office panel 14. A worksurface 16 or other accessory is mounted on the functional rail 12 via a pair of brackets 18, 20 that interfit within an accessory slot 60 in the functional rail 12 and are drawn together to lock the brackets 18, 20 at a fixed position along the rail 12.

II. Structure

In one embodiment, the system 10 of the present invention includes a functional rail 12 for supporting a variety of accessories. In the illustrated embodiment, the functional rail 12 is mounted to the top of a generally conventional panel 14 for use in a modular office system. Although there are a variety of standard configurations, these panels 14 typically include a pair of spaced apart vertical frame members 24 connected at their upper and lower ends by a pair of spaced apart horizontal frame members 26. A portion of the top horizontal frame member 26 is visible in FIG. 1. As shown, the top horizontal frame member 26 includes a pair of upwardly extending end rail members 28 separated by a trough 30. Although not shown, the upper surface of the trough 30 may include a series of fastener holes. In one embodiment, the frame members 24, 26 collectively form a front surface 31 and a rear surface 32. The front and rear surfaces 31, 32 may each be designed to support one or more cover panels 34. These cover panels 34 provide the panel system 14 with both aesthetic and functional qualities. For example, the cover panels 34 may be wrapped or otherwise covered with a decorative material or surface, and they may also provide a surface for supporting accessories as well as acoustical separation between various office spaces.

In the illustrated embodiment, the functional rail 12 is mounted on top of the panel 14, for example, with conventional fasteners extending between the functional rail 12 and the panel 14. The functional rail 12 includes longitudinal ends 36, and defines a length extending between the ends 36. The functional rail 12 further includes a top surface 38, bottom surface 40, front side surface 42 and opposing rear side surface 44. The bottom surface 40 is configured to attached to the panel 14. The bottom surface 40 may have a variety of configurations to enable such attachment, depending on the configuration of the panel 14. In the illustrated embodiment, the bottom surface 40 defines a pair of planar rail surfaces 48, 50 that extend the length of the rail 12 and align with the upwardly extending end rail members 28 of the top frame member 26. A central groove 52 divides the rail surfaces 48, 50 and may provide an opening for a nut, such that a fastener can extend upwardly through the panel and into the nut as an alternative to a series of holes extending through the rail 12. A pair of downwardly extending flanges 52, 54 extend from the bottom surface 40 on opposing sides of the rail surface 48, 50.

The functional rail 14 has a cross section that is designed to receive and attach accessories on each of the top 38 and side 42, 44 surfaces. The top surface 38 includes a central, upwardly facing channel 56, formed by a pair of channel sidewalls 58 and a channel floor 59. In one embodiment, the channel 56 includes step flanges 63 that project inwardly from the sidewalls 58 a portion of the channel width. In one embodiment the top surface 38 may additionally define a pair of auxiliary channels 69 on either side of the central channel 56. As shown, these auxiliary channels 69 are narrower in width than the central channel 56.

Figure 2:
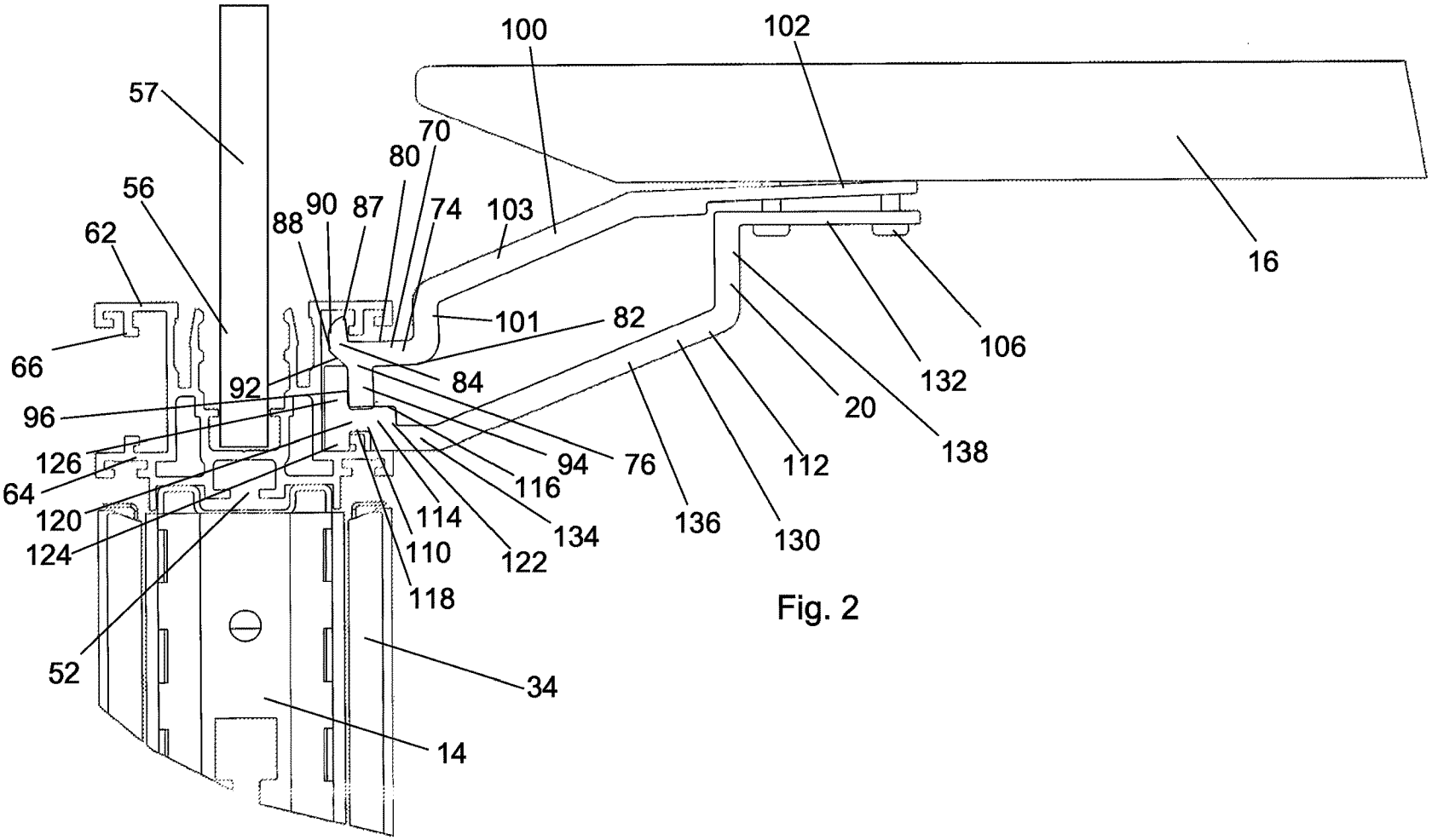
FIG. 2 is a side view thereof with the mounting brackets in an unfastened position.

As noted above, in addition to the central channel 56 defined in the top surface 38, the front and rear side surfaces 42, 44 are also configured to receive or attach one or more accessories. In one embodiment, the front and rear side surfaces 42, 44 are mirror images of one another; therefore, only one such surface will be described in detail. It should be known, however, that in another embodiment the front and rear side surfaces 42, 44 may be different from one another such that each can accommodate a different type of accessory. Referring to FIGS. 1 and 2, the front and rear side surfaces 42, 44 each define a side accessory slot 60, which may be a generally T-shaped slot 60, also referred to as a T-slot. The side accessory slot 60 may be defined between upper 62 and lower 64 sidewalls and include a floor 65. As shown, opposing walls 66 project inwardly from the sidewalls 62, 64 a portion of the width of the slot 60 to create the T-shape and form internal 67 and external 68 bearing surfaces. The length of these walls 66 may vary from application to application. In another embodiment, the slot 60 may include only one such wall 66 (such that the slot no longer forms a T-shape). As shown in FIGS. 1 and 2, the central channel 56 in the top surface 38 of the functional rail 12 is generally perpendicular to the accessory slots 60 in the front and rear side surfaces 42, 44, providing the functional rail 12 with three separate surfaces extending the length of the rail 12 that may be used for the attachment of one or more accessories to the rail 12.

A variety of brackets and other devices may be provided for hanging or otherwise inserting into the central channel 56 or the accessory slots 60 for attaching accessories to the rail. FIGS. 1-5 illustrate one embodiment of a set of brackets 18, 20 that interfit with the accessory slots 60 to mount an accessory, such as a worksurface 16 to the functional rail 12. More particularly, the set of brackets 18, 20 includes an upper bracket 18 and a lower bracket 20 that interfit with one another and with the accessory slot 60 to prevent removal of the brackets 18, 20 from the slot 60, and that can be drawn together to lock the brackets 18, 20 in the slot 60 at a desired position along the length of the slot 60.

Figure 3:
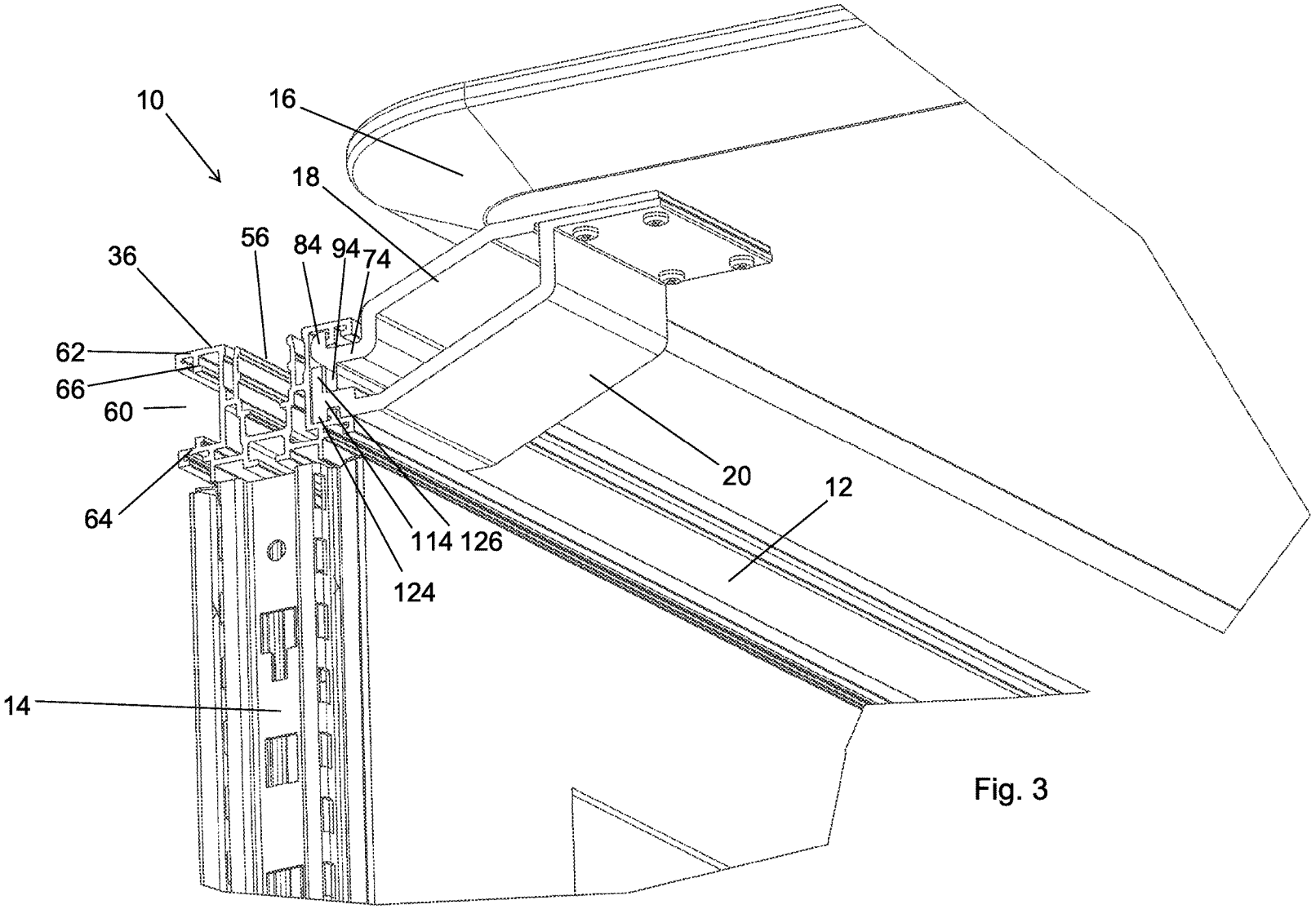
FIG. 3 is a lower perspective view of a functional rail mounted on a panel structure and a worksurface mounted on the functional rail.
Figure 4:
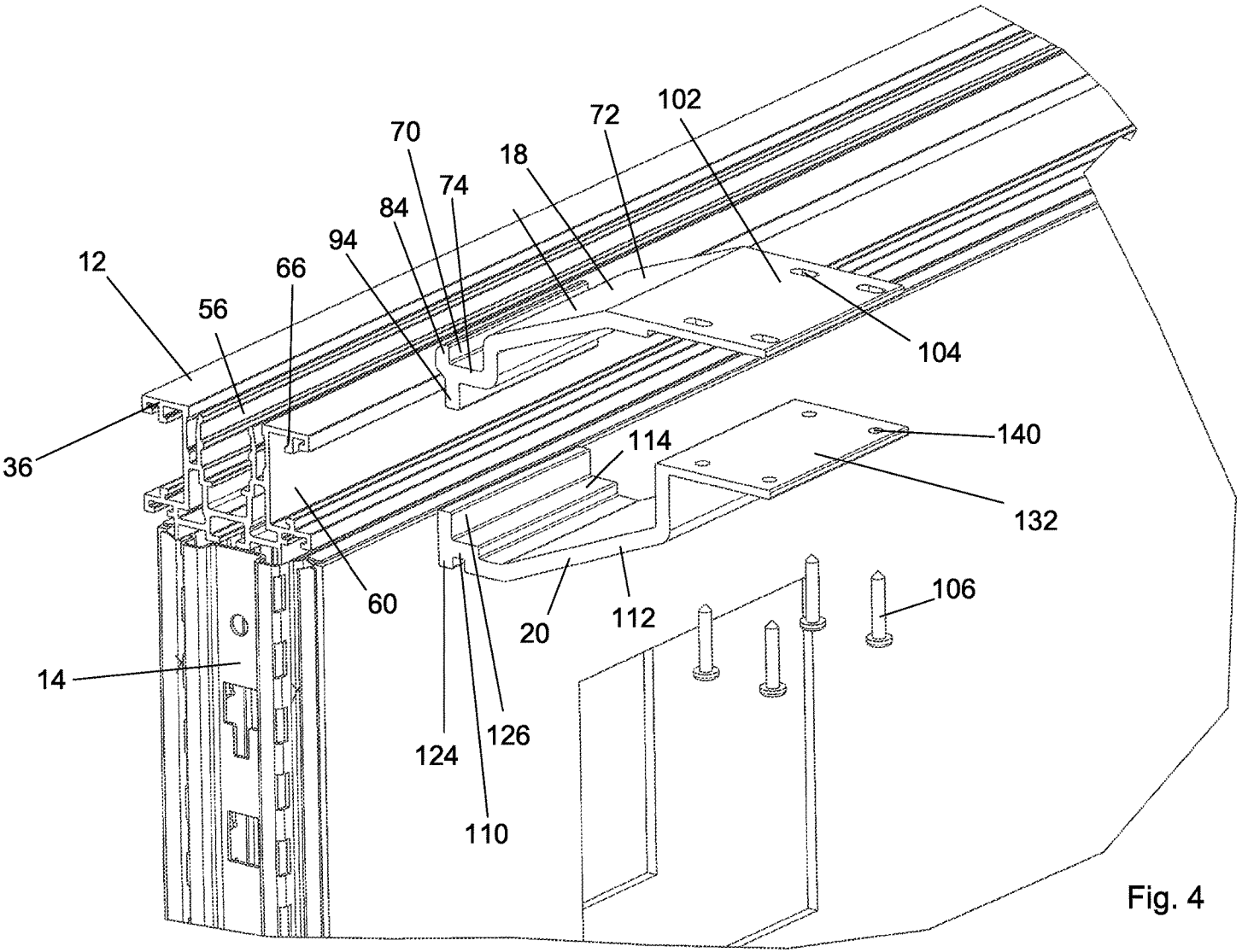
FIG. 4 is an upper exploded view.

As shown in FIGS. 1-5, the upper bracket 18, the upper bracket 18 is a generally rigid bracket with multiple sections, including a rail section 70 and a support section 72. The rail section 70 is designed to interfit with the functional rail 12 or the lower bracket 20 and the support section 72 extends away from the rail section 70 for attaching to an accessory, such as the worksurface 16, and for drawing the upper bracket 18 towards the lower bracket 20. In the illustrated embodiment, the rail section 70 includes a base 74 having a first end 76, a second end 78, an upper surface 80 and a lower surface 82. Referring to FIG. 2, a first leg 84 extends upwardly from the first end 76 of the base 74. In one embodiment the first leg 84 has an inner surface 87 and an outer surface 88 having a generally curved upper portion 90 and an angled lower portion 92. The lower portion 92 extends at about a 45 degree angle with respect to the upper surface 80 of the base 74. The rail section 70 of the upper bracket 18 also includes a second leg 94 that extends downwardly from the lower surface 82 of the base 74. In the illustrated embodiment, the second leg 94 includes an outer surface 96 that is generally aligned with the inner surface 87 of the first leg 84 and that abuts the angled lower portion 92 of the outer surface 88 of the first leg 84. In one embodiment, the support section 72 includes an extension arm 100 and an attachment arm 102. The extension arm 100 extends from the rail section 70. More particularly, in the illustrated embodiment, a first portion 101 of the extension arm 100 extends upwardly from the second end 78 of the base 74, forming a U-shape between the base 74, the first leg 84 and the first portion 101. A second portion 103 extends at approximately a 20 degree angle with respect to the first portion 101. The attachment arm 102 extends from the extension arm 100, and in the illustrated embodiment, the attachment arm 102 is angled with respect to the second portion 103 of the extension arm 100 such that the attachment arm 102 is generally parallel with the base 74 of the rail section 70. In another embodiment, the extension arm 100 and attachment arm 102 may extend at different angles from one another and from rail section 70, depending on the desired accessory to be attached of the desired application. Referring now to FIG. 4, the attachment arm 102 may include one or more holes 104 for receiving fasteners 106 that draw the upper and lower brackets 18, 20 together and attach the brackets 18, 20 to a worksurface 16.

Figure 5:
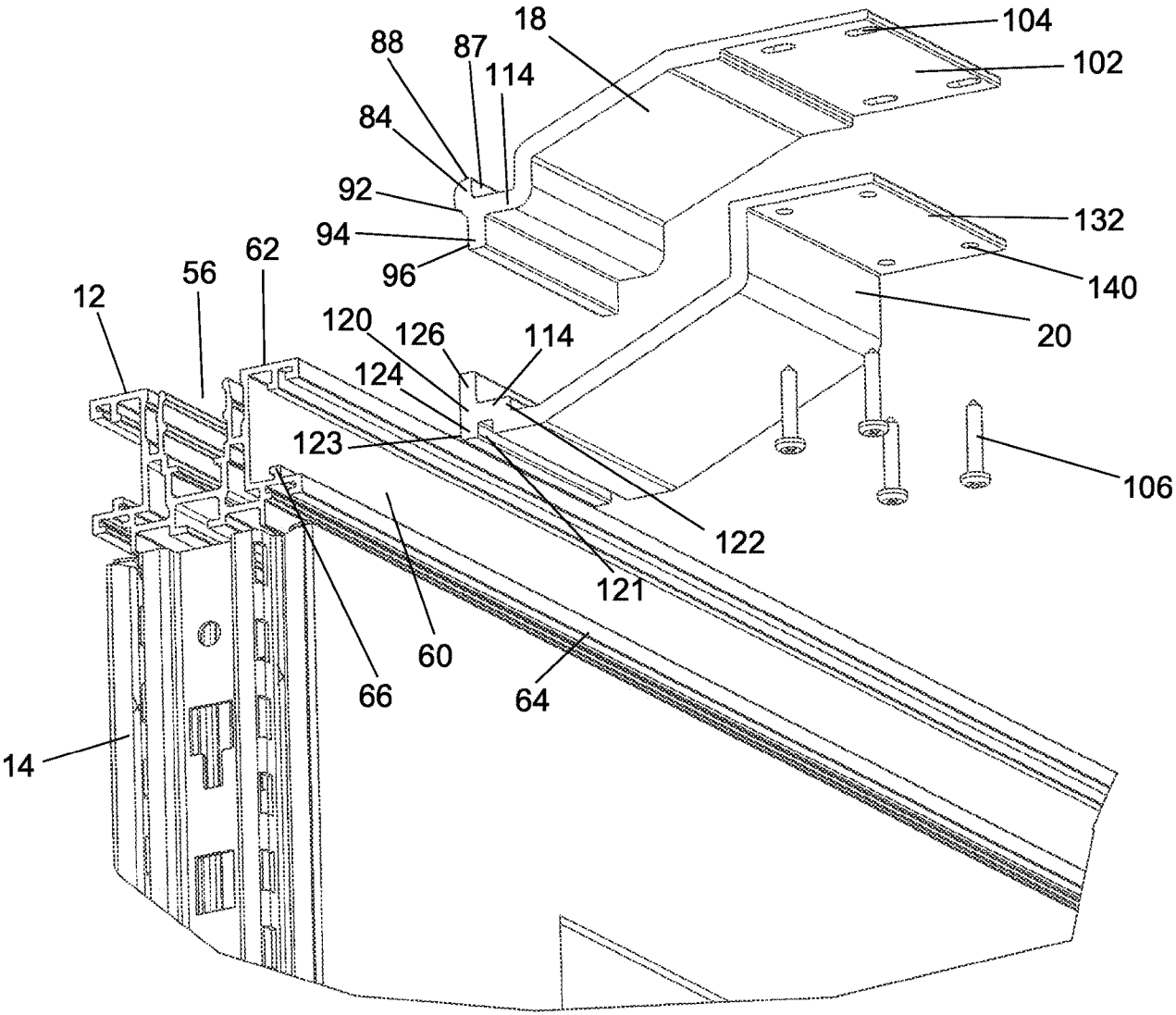
FIG. 5 is a lower exploded view.

Referring again to FIGS. 1-5 (and specifically FIG. 2), the lower bracket 20 includes a rail section 110 and a support section 112. The rail section 110 of the lower bracket 20 includes a base 114 having an upper surface 116, a lower surface 118, a first end 120 and a second end 122 opposite the first end 120. A first leg 124 extends downwardly from the first end 120 of the base 114 and includes an inner surface 121 facing towards the base 114 and an outer surface 123 facing away from the base 114. A second leg 126 extends upwardly from the first end 120 of the base 114. The support section 112 extends from the rail section 110. In the illustrated embodiment, the support section 112 includes an extension arm 130 and an attachment arm 132. The extension arm 130 extends from the second end 122 of the base 114, with a first portion 134 that is generally parallel to the base 114, a second portion 136 that extends at an angle from the first portion 134, and a third portion 138 that extends at an angle from the second portion 136. In the illustrated embodiment, the second portion 136 extends at about a 20 degree angle from the first portion 134. The third portion 138 extends at an angle from the second portion 136 such that it is generally perpendicular to the base 114. The attachment arm 132 extends at an angle from the third portion 138 of the extension arm 130 such that it is generally parallel to the base 114. Referring now to FIG. 5, the attachment arm 132 includes one or more holes 140 for receiving fasteners 106 that draw the upper and lower brackets 18, 20 together and attach the brackets 18, 20 to a worksurface 16.

As shown in FIGS. 1-3, the upper and lower brackets 18, 20 are configured to interfit with one another and the accessory slot 60 in the functional rail 12. FIG. 1 shows the brackets 18, 20 inserted in the slot 60 in a final, locked-in-place, position. As shown, the upper bracket 18 is inserted in the accessory slot 60 with the first leg 84 behind the wall 66 that extends from the upper sidewall 62, such that the inner surface 87 of the first leg 84 abuts the internal bearing surface 67 of the wall 66. The lower bracket 20 is inserted in the accessory slot 60 with the first leg 124 behind the wall 66 that extends from the lower sidewall 64. The second leg 126 of the lower bracket 20 extends behind the second leg 94 of the upper bracket 18 with the second leg 94 of the upper bracket 18 generally abutting the second leg 126 of the lower bracket 20.

As also shown in FIG. 1, the fasteners 106 extend through both the attachment arm 102 of the upper bracket 10 and the attachment arm 132 of the lower bracket 20 to draw the attachment arms 102, 132 into engagement with one another. In addition, the fasteners 106 may extend into the worksurface 16 to attach the worksurface 16 to the brackets 18, 20, thus supporting the worksurface 16.

In the illustrated embodiment, the accessory is shown as a worksurface 16; however, a variety of other accessories, such as storage units, shelving and lighting may otherwise be mounted to the accessory rail 60 with similar brackets and in a similar manner. In addition, one or more accessories may simultaneously be mounted to the central channel 56 by inserting a portion of the accessory or a bracket into the support channel 56. In one embodiment, shown in FIG. 2, the accessory may be a standard privacy screen 57 that is inserted into the channel 56 and retained by friction fit or another method.

III. Operation

Operation of the present invention generally includes the steps of: (a) mounting the functional rail 12 to a structure such as the top of a panel 14 (however, this step may not be necessary in every case because the rail only needs to be mounted an initial time), (b) inserting the upper and lower brackets 18, 20 into the accessory slot, (c) drawing the support portions of the respective brackets toward one another to lock the rail portions within the accessory slot and to lock the brackets in place along the length of the accessory slot, and (d) attaching an accessory to the brackets such that the accessory is supported by the functional rail 12 and the brackets 18, 20.

The mounting of the functional rail 12 to the panel may be done by conventional methods, for example, by extending a fastener through the rail 12 and into a portion of the panel 14, or by sliding a nut into the central groove 52 in the rail 12 and extending a fastener through the panel 14 and into the nut.

Inserting the upper and lower brackets 18, 20 into the accessory slot 60 includes inserting the rail sections 70, 110 of the upper 18 and lower 20 brackets respectively into the accessory slot 60. In one embodiment, this may require inserting the brackets 18, 20 at an angle with respect to one another, with the attachment arms 102, 132 spaced apart to enable the first leg 124 of the lower bracket 20 to extend behind the wall 66 extending from the lower sidewall 64 and to enable the first leg 84 of the upper bracket 18 to extend underneath and wrap behind the internal bearing surface 67 of the wall 66 that extends from the upper sidewall 62. FIG. 2 shows the brackets 18, 20 in this general position, with the second leg 126 of the lower bracket adjacent to the floor 65 of the slot 60 and the second leg 94 of the upper bracket 18 placed in front of the second leg 94 of the lower bracket 20, with the angled lower portion 92 of the first leg 84 abutting the upper edge of the second leg 126 of the lower bracket 20. As shown in FIG. 2, the attachment arms 102, 132 are spaced apart with fasteners 106 inserted through both of the attachment arms 102, 132 and into the worksurface 16 but not yet drawn together. In this position of FIG. 2, the brackets 18, 20 may still be capable of sliding along the length of the functional rail 12 within the side accessory slot 60.

The brackets 18, 20 may be locked into place along the length of the functional rail 12 by tightening the fasteners 106 to draw the attachment arms 102, 132 towards one another as shown in FIG. 1. In the illustrated embodiment, the attachment arms 102, 132 engage one another in this locked position. The process of tightening the fasteners 106 generally forces the second leg 94 of the upper bracket 18 into the second leg 126 of the lower bracket 20 the second leg 94 against the floor 65 of the slot 60. At the same time, the surface 87 of the first leg 84 is pressed horizontally into the wall 66 of the upper sidewall 62. The angled lower portion 92 of the first leg 84 may act like a wedge to drive the second leg 126 of the lower bracket 20 horizontally against the floor 65 of the slot. The horizontal forces of the inner surface 87 of the first leg 84 pressed against the wall 66 of the upper sidewall 62 and the second leg 94 of the upper bracket 18 pressing the second leg 126 of the lower bracket 20 against the floor 65 frictionally lock the brackets in place along the length of the slot 60.

Although not shown, a similar set of brackets 18, 20 may be attached in the accessory slot 60 on the rear side surface 44 of the functional rail 12, such that worksurfaces 16 can be supported simultaneously from both sides 42, 44 of the functional rail 12. In addition, another accessory, such as a privacy screen, may be inserted in to the central channel 56 of the top rail surface 38.

The above description is that of the current embodiment of the invention. Various alterations and changes can be made without departing from the spirit and broader aspects of the invention.

The invention claimed is:

1. A functional rail system for mounting a plurality of accessories, comprising:

an elongated rail having a longitudinal length, an upper surface, a lower surface, a first side surface and a second side surface opposite the first side surface;

a channel defined in said upper surface for receiving an accessory, said channel having a pair of opposing sidewalls joined by a channel floor;

a side accessory slot defined in at least one of said first side surface and said second side surface, said side accessory slot including an upper sidewall, a lower sidewall, and a floor, and including at least one wall extending into said slot from one of said upper sidewall and said lower sidewall; and an upper bracket and a lower bracket interfitted with each other and the accessory slot and cooperating with one another to prevent removal from said rail, each of said upper and lower brackets including a rail section and a support section, the rail sections extending into said accessory slot and the support sections extending outwardly from said accessory slot, a portion of one of said rail sections positioned behind said at least one wall extending into said slot, a portion of said upper bracket rail section positioned in front of a portion of lower bracket rail section.

2. The functional rail system of claim 1 including a modular office panel having a pair of vertical frame members joined by a pair of horizontal frame members, said horizontal and said vertical frame members collectively defining a front surface and an opposing rear surface, said front surface and said rear surface each covered with a cover panel mounted thereto, said horizontal frame members including a top frame member having an upper surface, wherein said lower surface of said elongated rail is mounted on said upper surface of said modular office panel.

3. The functional rail system of claim 2 wherein said elongated rail defines a height between said upper surface and said lower surface, wherein said central channel extends into said rail a majority of said height such that said channel is positioned behind said accessory slot.

4. The functional rail system of claim 3 wherein said lower surface of said elongated rail includes a first planar portion and a second planar portion separated by a groove, and wherein said upper surface of said top frame member includes raised portions aligned with said first and second planar portions.

5. The functional rail system of claim 4 wherein said side accessory slot includes at least one wall extending into said slot from each of said upper sidewall and said lower sidewall, said at least one walls aligned with one another to form a T-slot.

6. The functional rail system of claim 5 wherein a first portion of said rail section of said upper bracket is positioned in front of a portion of rail section of said lower bracket and wherein a second portion of said rail section of said upper bracket is positioned behind said at least one wall extending into said slot.

7. The functional rail system of claim 6 wherein said support section of said upper bracket is attached to said support section of said lower bracket.

8. The functional rail system of claim 7 wherein a portion of a worksurface is mounted on said support section of said upper bracket, and where at least one fastener extends through said lower bracket, said upper bracket and into said worksurface to draw said brackets together and also mount said worksurface.

9. The functional rail system of claim 8 wherein an accessory is inserted into the central channel, said accessory extending upwardly from said upper surface of said elongated rail.

10. The functional rail system of claim 9 wherein said accessory is a privacy screen.

11. The functional rail system of claim 8 wherein said accessory extends into said central channel to abut said channel floor.

12. The functional rail system of claim 11 wherein said accessory is retained in said central channel with a friction fit.

13. A functional rail system for supporting a worksurface, comprising:

an elongated rail having a longitudinal length, an upper surface, a lower surface a first side surface and a second side surface opposite the first side surface;

a side accessory slot defined in at least one of said first side surface and said second side surface, said side accessory slot including an upper sidewall, a lower sidewall, and a floor, and including at least one wall extending into said slot from one of said upper sidewall and said lower sidewall; and an upper bracket and a lower bracket interfitted with each other and said side accessory slot, each of said upper and lower brackets including a rail section and a support section, wherein at least a portion of each of said rail sections extends into said side accessory slot wherein a portion of said rail section of said upper bracket is positioned in front of a portion of rail section of said lower bracket to prevent removal of said lower bracket from said side accessory slot, wherein a worksurface is attached to said support sections of one of said upper and lower brackets.

14. The functional rail system of claim 13 wherein said upper bracket rail section includes a base, a first leg extending upwardly from said base and a second leg extending downwardly from said base, wherein said first leg is positioned in said accessory slot behind said at least one wall extending into said slot from one of said upper sidewall and said lower sidewall, wherein said second leg is positioned in front of a portion of said lower bracket, wherein said first leg abuts said at least one wall extending into said slot.

15. The functional rail system of claim 14 wherein said lower bracket rail section includes a base and a second leg extending upwardly from said base, said second leg positioned between said second leg of said upper bracket and said accessory slot floor.

16. The functional rail system of claim 15 wherein said support sections of said upper and lower brackets are spaced from said elongated rail, and wherein said support sections are connected to each other such that said second leg of said upper bracket is pressed against said second leg of said lower bracket.

17. The functional rail system of claim 16 wherein an inner surface of the first leg of the upper bracket is horizontally pressed against said wall extending from said upper sidewall of said slot and said second leg of said upper bracket horizontally presses said second leg of said lower bracket against said floor of said slot to frictionally lock said brackets in place along said longitudinal length of said slot.

18. A method of mounting a worksurface on a functional rail, comprising:

(a) providing a functional rail having a longitudinal length, an upper surface, a lower surface a first side surface and a second side surface opposite the first side surface, at least one of the first side surface and the second side surface defining an accessory slot, the accessory slot having an upper sidewall, a lower sidewall, and an intermediate wall extending into said slot from one of said upper and lower sidewalls;

(b) inserting upper and lower brackets into the accessory slot such that said upper and lower brackets interfit with each other and said slot, the brackets each including a rail portion and a support portion spaced from the rail portion, the rail portions of the brackets cooperating with each other within the accessory slot to prevent removal from the accessory slot, wherein the rail portion of one of the brackets is at least partially positioned behind the intermediate wall;

(c) drawing the support portions of the respective brackets toward one another to lock the rail portions of the brackets within the accessory slot and to lock the brackets in place along the length of the accessory slot, and (d) attaching an accessory to the support portion of at least one of the brackets such that the accessory is supported by the functional rail and the brackets.

19. The method of claim 18 including providing the upper bracket rail section with a base, a first leg extending upwardly from the base and a second leg extending downwardly from the base, and positioning the first leg in the accessory slot behind the intermediate wall, wherein the second leg is positioned in front of a portion of the lower bracket.

20. The method of claim 19 wherein the step of drawing the support portions toward one another presses an inner surface of the first leg of the upper bracket horizontally against the intermediate wall and also presses the second leg of the upper bracket horizontally against the second leg of the lower bracket to press the second leg of the lower bracket against the floor of the slot to lock the brackets in place along the longitudinal length of the slot.

* * * * *